US006719414B2

(12) United States Patent
Sole et al.

(10) Patent No.: US 6,719,414 B2
(45) Date of Patent: Apr. 13, 2004

(54) INK TUBE CARRIER FOR A PRINTER, AND METHOD

(75) Inventors: Macia Sole, Barcelona (ES); Jeffrey L. Thielman, Corvallis, OR (US); John C. Ayre, Lincoln (GB)

(73) Assignee: Hewlett-Packard Development Company, LP, Houston, TX (US)

( * ) Notice: Subject to any disclaimer, the term of this patent is extended or adjusted under 35 U.S.C. 154(b) by 0 days.

(21) Appl. No.: 10/210,337

(22) Filed: Jul. 31, 2002

(65) Prior Publication Data

US 2004/0021746 A1 Feb. 5, 2004

(51) Int. Cl.[7] ..... B41J 2/175
(52) U.S. Cl. ..... 347/85
(58) Field of Search ..... 347/84, 85–87; 138/111, 115, 137–139

(56) References Cited

U.S. PATENT DOCUMENTS

| | | | | | |
|---|---|---|---|---|---|
| 3,683,410 A | * | 8/1972 | Fowler | ..... | 346/117 A |
| 5,025,270 A | * | 6/1991 | Umezawa | ..... | 347/85 |
| 5,473,354 A | * | 12/1995 | Arquilevich et al. | ..... | 347/85 |
| 5,988,801 A | * | 11/1999 | Coiner | ..... | 347/85 |

* cited by examiner

*Primary Examiner*—Stephen D. Meier
*Assistant Examiner*—An H. Do

(57) ABSTRACT

An integrally-formed ink tube carrier for a printer is disclosed which has a plurality of carrier tubes arrayed in a substantially rectilinear fashion. The tubes are connected by integrally-formed connecting regions. The carrier tubes used to hold ink tubes are preferably closed, thus providing a secondary containment in the event of an ink leak. One or more of the tubes may be slit, allowing the insertion of electrical wires. The ink tube carrier is preferably formed of a plasticized nylon, an elastomeric polybutylene terephthalate (PBT), elastomeric nylon, or polyether block amides.

21 Claims, 3 Drawing Sheets

INK TUBE CARRIER FOR A PRINTER, AND METHOD

BACKGROUND OF THE INVENTION

A conventional printer, such as an ink jet printer, may include an ink supply station and a print head that is movable with respect to the ink supply station. Consequently, a set of long, durable, bendable ink tubes—one for each ink color—may be used to supply ink from the ink supply station to the moving print head. Because the print head requires electrical power, a set of long, durable, bendable electrical wires may be used to supply power and/or data from the printer electronics to the moving print head.

SUMMARY OF THE INVENTION

The present invention comprises, in one embodiment, an ink tube carrier for a printer, comprising: a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, and wherein at least one of the carrier tubes is a closed tube, wherein a closed tube is configured so that a cross section of the closed tube has a closed configuration.

In a further embodiment of the present invention, an ink tube carrier for a printer is provided, comprising: a plurality of carrier tubes connected by connecting regions, wherein at least four of the carrier tubes are closed tubes, wherein a closed tube is configured so that a cross section of the closed tube has a closed configuration, and wherein at least two of the carrier tubes are open tubes, wherein an open tube includes a slit that runs the length of the open tube, wherein the slit is configured to be opened to allow the passage of electrical wires into and out of the open tube.

In a further embodiment of the present invention, an ink tube carrier for a printer is provided, comprising: a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, wherein each carrier tube has an inside diameter of between approximately 2.5 mm and 8.5 mm, and wherein the carrier comprises one of plasticized nylon, elastomeric polybutylene terephthalate (PBT), elastomeric nylon, and polyether block amides.

In a further embodiment of the present invention, an ink jet printer system is provided, comprising: a beam; an ink supply station configured to hold an ink cartridge and connected to the beam; a carriage comprising a print head and movable on the beam; ink tubes, provided between the carriage and one of the beam and ink supply station, configured to transfer ink to the carriage; electrical wires, provided between the carriage and one of the beam and printer controller, configured to provide electrical power and/or data to the carriage; and an ink tube carrier, provided between the carriage and one of the beam and ink supply station, configured to house the ink tubes and electrical wires, and having a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, and wherein at least one of the carrier tubes is a closed tube, wherein a closed tube is configured so that a cross section of the closed tube has a closed configuration.

In a yet further embodiment of the present invention, a method for holding ink tubes and electrical wires is provided, comprising: providing an ink tube carrier having a plurality of carrier tubes connected by connecting regions, wherein at least four of the carrier tubes are closed tubes, wherein a closed tube is configured so that a cross section of the closed tube has a closed configuration, and wherein at least two of the carrier tubes are open tubes, wherein an open tube includes a slit that runs the length of the open tube, wherein the slit is configured to be opened to allow the passage of electrical wires into and out of the open tube; inserting each ink tube of a printer into an open end of a closed tube and threading said ink tube through said closed tube; and opening a slit of an open tube and passing electrical wires of the printer into said open tube.

DETAILED DESCRIPTION OF THE INVENTION

Figure 1:
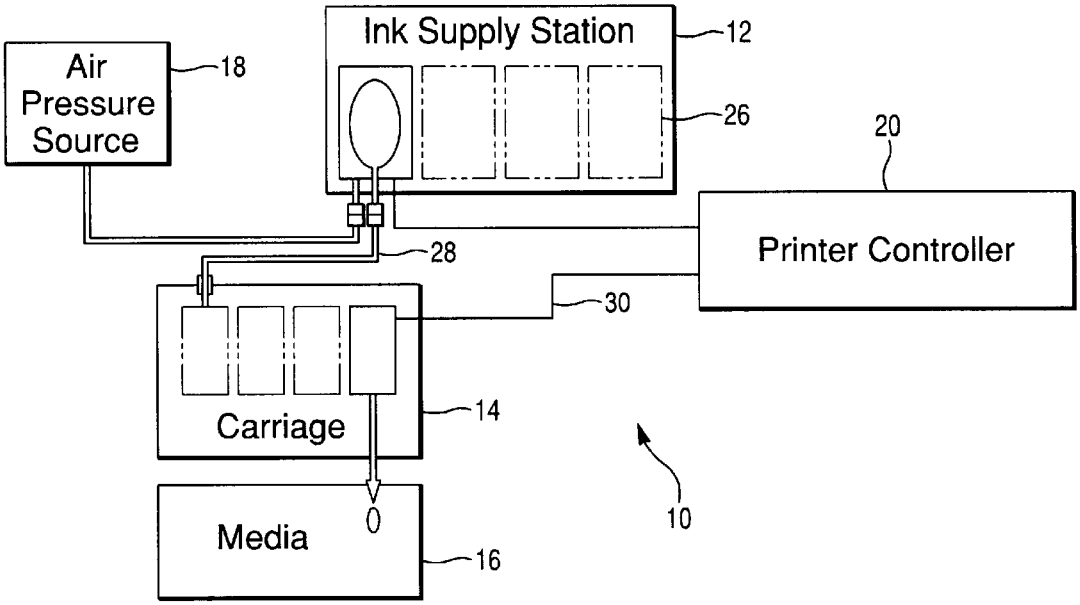
FIG. 1 is a schematic drawing of an embodiment of the ink jet printer system according to the present invention.
Figure 2:
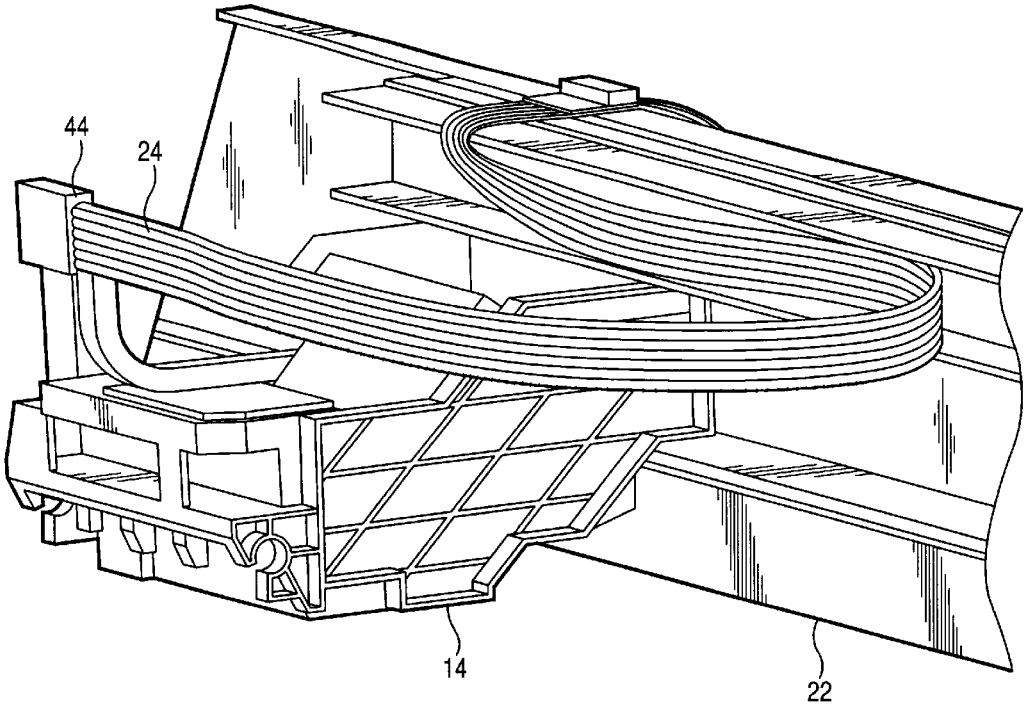
FIG. 2 is a perspective drawing of an embodiment of the ink jet printer system according to the present invention.

Referring to FIGS. 1 and 2, an exemplary ink jet printer system 10 includes an ink supply station 12, a carriage 14, an air pressure source 18, a printer controller 20, a beam 22, and ink tubes 28 and electrical wires 30 housed inside an ink tube carrier 24. The system 10 is configured to print an image on media 16, such as printer paper.

As shown in FIG. 1, the ink supply station 12 contains ink cartridges 26, which contain ink. The cartridges 26 may each contain a different color of ink. For example, as shown in FIG. 1, four cartridges 26 may hold four different ink colors. The ink supply station 12 is configured to supply ink from the cartridges 26 to the carriage 14 via ink tubes 28. The pressure necessary to provide proper ink flow from the cartridges 26 to the carriage 14 may be provided by an air pressure source 18, although other current and future means of providing the proper ink flow will be obvious to one skilled in the art. The printer controller 20 is configured to provide electrical power and/or control signals to the carriage 14 via electrical wires 30.

As shown in FIG. 2, the carriage 14 is connected to and movable on the beam 22. The carriage 14 contains a print head (not shown), through which ink provided from the cartridges 26 flows to the media or paper 16. The ink tubes 28 extend from the ink supply station 12 to the carriage 14, and the electrical wires 30 extend from the controller 20 to the carriage 14, via an ink tube carrier 24. The ink tubes 28 and electrical wires 30 are not shown in FIG. 2 because they are housed inside the ink tube carrier 24.

The ink tube carrier 24 is configured to hold and house the ink tubes 28 and the electrical wires 30 so that they do not become tangled or damaged by the moving carriage 14. In other words, the ink tube carrier 24 is configured to keep the ink tubes 28 and electrical wires 30 together, as well as to keep their motion and position (with respect to the carriage 14) predictable and consistent. As shown in FIG. 2, the ink tube carrier 24 is configured to freely bend in a lengthwise direction.

The carrier may comprise one of plasticized nylon, elastomeric PBT, elastomeric nylon, and polyether block amides, because these materials are durable, reasonably resistant to wear, and flexible enough to allow the ink tube carrier 24 to freely bend in a lengthwise direction.

The ink tube carrier 24 need not run the entire length between the ink supply station 12 and the carriage 14 (or the entire length between the controller 20 and the carriage 14). In an embodiment, the ink tubes 28 and electrical wires 30 may mate at the beam 22, and the ink tube carrier 24 may be provided on the ink tubes 28/electrical wires 30 between the point of mating on the beam 22 and the carriage 14. In other words, the ink tube carrier 24 may be provided only where the ink tubes 28/electrical wires 30 move or bend as a result of the motion of the carriage 14 on the beam 22. Because the range of motion of the carriage 14 may be as much as 2 m, the ink tube carrier 24 may also have a length of between approximately 0.5 m and 2.5 m, preferably approximately 2 m.

Figure 3:
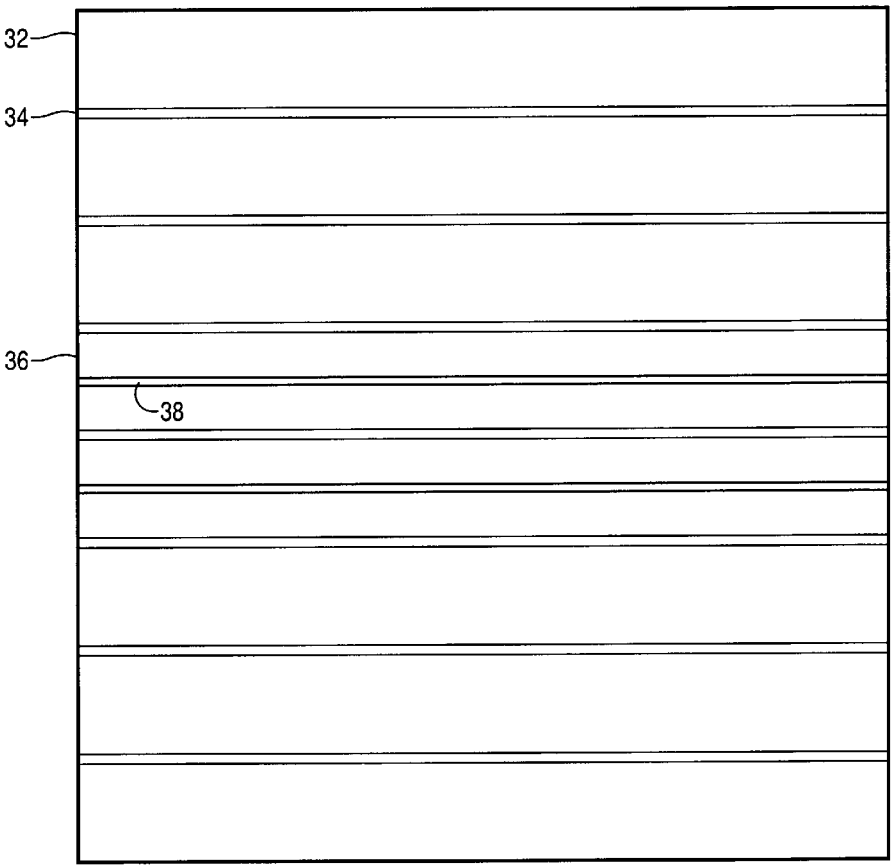
FIG. 3 is a side drawing of an embodiment of the ink tube carrier according to the present invention.
Figure 4:
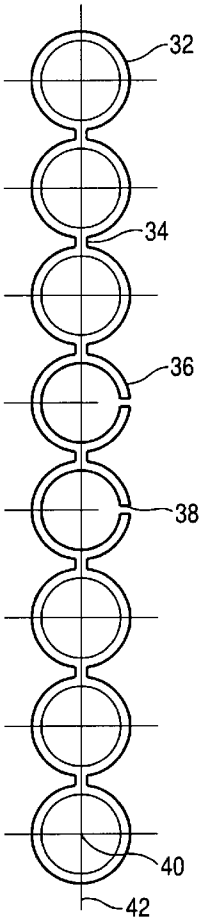
FIG. 4 is a cross sectional view of the ink tube carrier shown in FIG. 3.

As shown in FIGS. 3 and 4, the ink tube carrier 24 may include a plurality of carrier tubes, such as closed tubes 32 and open tubes 36, connected by connecting regions 34. A closed tube is one that is configured so that a cross section (as shown in FIG. 4) has a closed configuration. An open tube is one that includes a slit 38 that runs the length of the tube, where the slit 38 is configured to be opened to allow the passage of electrical wires 30 (or ink tubes 28) into and out of the tube. In FIG. 4, for clarity of explanation, the slit 38 is shown having a nonzero width. However, the slit 38 may have substantially no width, such as where an open tube 36 is created by cutting a slit 38 into a previously closed tube 32.

The carrier tubes 32, 36 have approximately the same length (e.g., 2 m) and ends of the carrier tubes 32, 36 are approximately flush, as shown in FIG. 2. The closed tubes 32 are configured to house ink tubes 28 having an outside diameter of between approximately 2 mm and 8 mm; therefore, each closed tube 32 (and preferably each open tube 36) has an inside diameter of between approximately 2.5 mm and 8.5 mm, or preferably between approximately 4.5 mm and 5.5 mm. Further, each carrier tube 32, 36 may have a wall thickness of between approximately 0.4 mm and 0.8 mm.

In an embodiment, the closed tubes 32, open tubes 36, and connecting regions 34 may be integrally connected. Each connecting region 34 between adjacent carrier tubes 32, 36 may have a width of between approximately 0.3 mm and 0.7 mm. Further, each connecting region 34 may have a thickness of between approximately 0.8 mm and 1.2 mm. Alternatively, the carrier tubes 32, 36 may be formed separately and connected by adhesive (i.e., the connecting regions 34 are strips of adhesive), or by melting them together (i.e., the connecting regions 34 are melted regions of adjacent carrier tubes 32, 36). In this embodiment, each connecting region 34 between adjacent carrier tubes 32, 36 may have an approximately zero width. There are a variety of other connection methods that may be used.

In an embodiment, the ink tube carrier 24 may be configured so that centers 40 of the carrier tubes 32, 36 in a cross section of the ink tube carrier 24 are approximately rectilinear so that they lie on a line 42, as shown in FIG. 4. In this embodiment, the ink tube carrier 24 is configured as a bendable ribbon, as shown in FIG. 2.

In an embodiment, the ink tube carrier 24 has exactly four closed tubes 32, one closed tube 32 for each of four ink tubes 28, and exactly two open tubes 36, configured to house electrical wires 30. In another embodiment, the ink tube carrier 24 has exactly six closed tubes 32 and exactly two open tubes 36. The ink tube carrier 24 could, of course, have only closed tubes 32 or only open tubes 36, or different numbers of each. An advantage of using closed tubes 32 for the ink tubes 32 is that, in the case of a breach of an ink tube 28, the ink will be contained inside the corresponding closed tube 32 and will only be able to leak from the closed tube 32 at one of the two open ends of the closed tube 32. An advantage of using open tubes 36 for the electrical wires 30 is that the electrical wires 30 may be easily inserted into the open tubes 36 via the slits 38. An advantage to using an open tube for the electrical wires is that electrical wires with connectors attached can be inserted into the open tubes via the slits.

An end 44 of the ink tube carrier 24 may be connected to the carriage 14, e.g., with screws, adhesive, or snap-on connectors (other means of connection would be obvious to one skilled in the art). The end 44 may also be sealed to the carriage 14 to prevent leakage of ink from the point of connection between the ink tube carrier 24 and the carriage 14 in the event of a breach of an ink tube 28. In the case of a breach of an ink tube 28, the ink will then only be able to leak from its corresponding closed tube 32 at an opposite end of the ink tube carrier 24 (e.g., the end closer to the beam 22 or ink supply station 12). The ink jet printer system 10 may be configured to detect a leakage of ink from the opposite end.

By way of example, the ink tube carrier 24 may be attached to the system 10 in the following way. For each ink tube 28, a loose end of the ink tube 28 may be inserted into an open end of a closed tube 32; the ink tube 28 may then be threaded all the way through the closed tube 32 so that the end of the ink tube 28 protrudes from the closed tube 32; the end of the ink tube 28 may then be attached to the carriage 14. After this has been performed for all ink tubes 28, the end 44 of the ink tube carrier 24 may be connected to and/or sealed to the carriage 14 (so that ink can flow to the print head). Then, the electrical wires 30 may be inserted into one or more open tubes 36 by opening a slit 38 of the open tube 36 and passing the electrical wires into the open tube 36.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described to explain the principles of the invention and as a practical application to enable one skilled in the art to utilize the invention in various embodiments and with various modifications suited to the particular use contemplated. It is intended that the scope of the invention be defined by the claims appended hereto and their equivalents.

What is claimed is:

1. An ink tube carrier for a printer, comprising:

a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, wherein at least one of the carrier tubes is a closed tube, wherein the closed tube is configured so that a cross section of the closed tube has a closed configuration, and wherein at least one of the carrier tubes is an open tube, wherein the open tube includes a slit that runs substantially the length of the open tube, wherein the slit is configured to be opened.

2. The ink tube carrier as in claim 1, wherein the carrier is configured to freely bend in a lengthwise direction.

3. The ink tube carrier as in claim 1, wherein the carrier is formed of a material selected from the group consisting of plasticized nylon, elastomeric polybutylene terephthalate (PBT), elastomeric nylon, and polyether block amides.

4. The ink tube carrier as in claim 1, wherein the carrier tubes have approximately the same length and ends of the carrier tubes are approximately flush.

5. The ink tube carrier as in claim 1, wherein a length of the carrier is between approximately 0.5 m and 2.5 m.

6. The ink tube carrier as in claim 1, wherein a length of the carrier is approximately 2 m.

7. The ink tube carrier as in claim 1, wherein each carrier tube has an inside diameter of between approximately 2.5 mm and 8.5 mm.

8. The ink tube carrier as in claim 1, wherein each carrier tube has an inside diameter of between approximately 4.5 mm and 5.5 mm.

9. The ink tube carrier as in claim 1, wherein each carrier tube has a wall thickness of between approximately 0.4 mm and 0.8 mm.

10. The ink tube carrier as in claim 1, wherein, in a cross section of the carrier, each connecting region between adjacent carrier tubes has a width of between approximately 0.3 mm and 0.7 mm.

11. The ink tube carrier as in claim 1, wherein each connecting region has a thickness of between approximately 0.8 mm and 1.2 mm.

12. An ink tube carrier for a printer, comprising:

a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, wherein at least one of the carrier tubes is a closed tube, wherein the closed tube is configured so that a cross section of the closed tube has a closed configuration, and wherein the carrier comprises two to three open tubes, configured to hold electrical wires, and four to nine closed tubes, configured to hold ink tubes.

13. The ink tube carrier as in claim 12, wherein the carrier comprises two open tubes, configured to hold electrical wires, and six closed tubes, configured to hold ink tubes.

14. An ink tube carrier for a printer, comprising:

a plurality of carrier tubes connected by connecting regions, wherein at least four of the carrier tubes are closed tubes, wherein a closed tube is configured so that a cross section of the closed tube has a closed configuration, and wherein at least two of the carrier tubes are open tubes, wherein an open tube includes a slit that runs substantially the length of the open tube, wherein the slit is configured to be opened to allow the passage of electrical wires into and out of the open tube.

15. An ink tube carrier for a printer, comprising:

a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, wherein each carrier tube has an inside diameter of between approximately 2.5 mm and 8.5 mm, wherein the carrier is formed of a material selected from the group consisting of plasticized nylon, elastomeric polybutylene terephthalate (PBT), elastomeric nylon, and polyether block amides, and wherein at least one of the carrier tubes is a closed tube, wherein the closed tube is configured so that a cross section of the closed tube has a closed configuration.

16. An ink tube carrier for a printer, comprising:

a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, wherein each carrier tube has an inside diameter of between approximately 2.5 mm and 8.5 mm, wherein the carrier comprises one of plasticized nylon, elastomeric PBT, elastomeric nylon, and polyether block amides, and wherein at least one of the carrier tubes is an open tube, wherein the open tube includes a slit that runs the length of the open tube, wherein the slit is configured to be opened to allow the passage of electrical wires into and out of the open tube.

17. An ink jet printer system, comprising:

a beam;

an ink supply station configured to hold an ink cartridge and connected to the beam;

a carriage comprising a print head and movable on the beam;

ink tubes, provided between the carriage and one of the beam and ink supply station, configured to transfer ink to the carriage;

electrical wires, provided between the carriage and one of the beam and printer controller, configured to provide electrical power and/or data to the carriage; and an ink tube carrier, provided between the carriage and one of the beam and ink supply station, configured to house the ink tubes and electrical wires, and having a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, and wherein at least one of the carrier tubes is a closed tube, wherein the closed tube is configured so that a cross section of the closed tube has a closed configuration.

18. The ink jet printer system as in claim 17, wherein an end of the carrier is connected to the carriage.

19. The ink jet printer system as in claim 17, wherein an end of the carrier is connected and sealed to the carriage to prevent leakage of ink from the point of connection between the carrier and the carriage in the event of a breach of an ink tube.

20. An ink jet printer system, comprising:

a beam;

an ink supply station configured to hold an ink cartridge and connected to the beam;

a carriage comprising a print head and movable on the beam;

ink tubes, provided between the carriage and one of the beam and ink supply station, configured to transfer ink to the carriage;

electrical wires, provided between the carriage and one of the beam and printer controller, configured to provide electrical power and/or data to the carriage; and an ink tube carrier, provided between the carriage and one of the beam and ink supply station, configured to house the ink tubes and electrical wires, and having a plurality of carrier tubes, wherein, in a cross section of the carrier, centers of the carrier tubes are approximately rectilinear, wherein adjacent carrier tubes are connected by connecting regions, and the carrier tubes and connecting regions are integrally formed, wherein at least one of the carrier tubes is a closed tube, wherein the closed tube is configured so that a cross section of the closed tube has a closed configuration, and wherein at least one of the carrier tubes is an open tube, wherein the open tube includes a slit that runs the length of the open tube, wherein the slit is configured to be opened to allow the passage of the electrical wires into and out of the open tube.

21. A method for holding ink tubes and electrical wires, comprising:

providing an ink tube carrier having a plurality of carrier tubes connected by connecting regions, wherein at least four of the carrier tubes are closed tubes, wherein a closed tube is configured so that a cross section of the closed tube has a closed configuration, and wherein at least two of the carrier tubes are open tubes, wherein an open tube includes a slit that runs the length of the open tube, wherein the slit is configured to be opened to allow the passage of electrical wires into and out of the open tube;

inserting each ink tube of a printer into an open end of one of the closed tubes and threading said ink tube through said closed tube; and opening the slit of one of the open tubes and passing electrical wires of the printer into said open tube.

* * * * *